United States Patent [19]

Volz et al.

[11] 4,258,675

[45] Mar. 31, 1981

[54] REGULATOR APPARATUS SUCH AS A CENTRIFUGAL GOVERNOR FOR INTERNAL COMBUSTION ENGINES

[75] Inventors: Werner Volz, Nürtingen; Friedrich Rüsseler, Ditzingen; Ernst Ritter; Reinhard Schwartz, both of Stuttgart, all of Fed. Rep. of Germany

[73] Assignee: Robert Bosch GmbH, Stuttgart, Fed. Rep. of Germany

[21] Appl. No.: 11,575

[22] Filed: Feb. 12, 1979

[30] Foreign Application Priority Data

Feb. 24, 1978 [DE] Fed. Rep. of Germany ..... 2807026

[51] Int. Cl.[3] ..... F02D 1/04

[52] U.S. Cl. ..... 123/374; 123/373

[58] Field of Search ..... 123/140 R, 140 A, 111, 123/114, 123, 97 R; 64/25

[56] References Cited

U.S. PATENT DOCUMENTS 3,903,860 9/1975 Maier ..... 123/140 R

*Primary Examiner*—Harry N. Haroian

*Attorney, Agent, or Firm*—Edwin E. Greigg

[57] ABSTRACT

A regulator apparatus controlled by spring tension, such as a centrifugal governor for internal combustion engines wherein the spring characteristic of the regulator spring remains unchanged during operation and a regulator effectiveness which remains the same over a long period of time is attainable and which includes at least one compression spring acting as the regulator spring and inserted between two supports as well as an actuation member to transfer those regulator motions which tend to cause a change in length of the spring over onto the first spring end, which actuation member can tilt about a transverse shaft disposed perpendicularly to the longitudinal axis of the spring, the compression spring intentionally inserted into an installed position such that a point on the front face of the appropriate spring end, which point transfers the largest spring force component onto the spring support associated with the tiltable actuation member lies in a plane extending parallel to the longitudinal shaft of the spring and penetrating the transverse axis of the actuation member so that undesired tilting movements of the actuation member caused by the spring force exerted eccentrically on the spring supports are eliminated and the installation position of the compression springs which is in accordance with the invention is fixed by fastening means.

9 Claims, 3 Drawing Figures

REGULATOR APPARATUS SUCH AS A CENTRIFUGAL GOVERNOR FOR INTERNAL COMBUSTION ENGINES

BACKGROUND OF THE INVENTION

The invention relates to a regulator apparatus controlled by spring tension, and more particularly a centrifugal governor for internal combustion engines. In known centrifugal governors, which are built into rpm governors for internal combustion engines such as the idling and final rpm governor RQ shown in Brochure VDT-UBP 210/1 of Robert Bosch GmbH, functional problems rise continually, such as undesired adaptation, premature deregulation, sluggish transfers between the rpm levels and rpm drop, which were previously caused primarily by tolerance of mass and tolerances for installation purposes as well as clearances between the individual components and incorrect setting. In recent research, however, it has been determined that the eccentric exertion of force at the spring end in a spring support which can tilt about a transverse axis disposed perpendicularly to the longitudinal spring axis should be seen as the primary cause of the faults occuring in governors. These faults occur more often when the position of the eccentric exertion of force of the regulator spring is transverse to the axis of the spring support.

If the regulator spring is installed with no initial stressing, or very little, as in the rpm-adjustment governor RQV of Robert Bosch GmbH, Stuttgart, then it can rotate during operation, so that the point on the front face of the particular spring end which transfers the largest spring force component to the spring support varies its position and thereby causes a change in the maximal rpm (rpm drop).

OBJECT AND SUMMARY OF THE INVENTION

The regulator apparatus or centrifugal governor according to the invention has the advantage over the prior art in that the undesired tilting movements of the actuation member caused by the eccentric exertion of spring force on the spring supports are eliminated, since because of the installed position of the compression screws in accordance with the invention, there is no further tilting torque on the actuation member. In accordance with the novel construction of the invention, where springs which are installed without initial stressing or with very little stressing, an unintended change of position is prevented when the installation position of the regulator springs is obtained by fastening means between at least one spring end and the associated spring support and this spring support in turn is installed in such a way that it is secured in position at least against rotation. In a regulator apparatus which is arranged as a centrifugal governor and which contains two symmetrically disposed flyweights serving as actuation members and articulatedly connected with transfer levers through a transverse shaft, which flyweights enclose the regulator springs within a stepped central bore, whereby one spring support is formed by a particular step in the central bore or is supported thereupon in the form of a spring plate and the other spring support comprises a spring plate fixed onto a stay bolt, the installation position of the regulator springs is determined in a particularly advantageous manner by fastener means between at least one spring end and a spring plate which in turn is fixed or guided in a rotationally secure fashion or by the step in the central bore of the flyweights. Mechanical detent or holding means can advantageously act as the fastening means, such as a pointed projection, which engages a corresponding notch on the spring end, or metallic bonding agents; or at least one spring end and/or one spring support is provided with an upper surface which increases the adhesive friction. The last two means do not disadvantageously influence the tensile strength of the spring.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
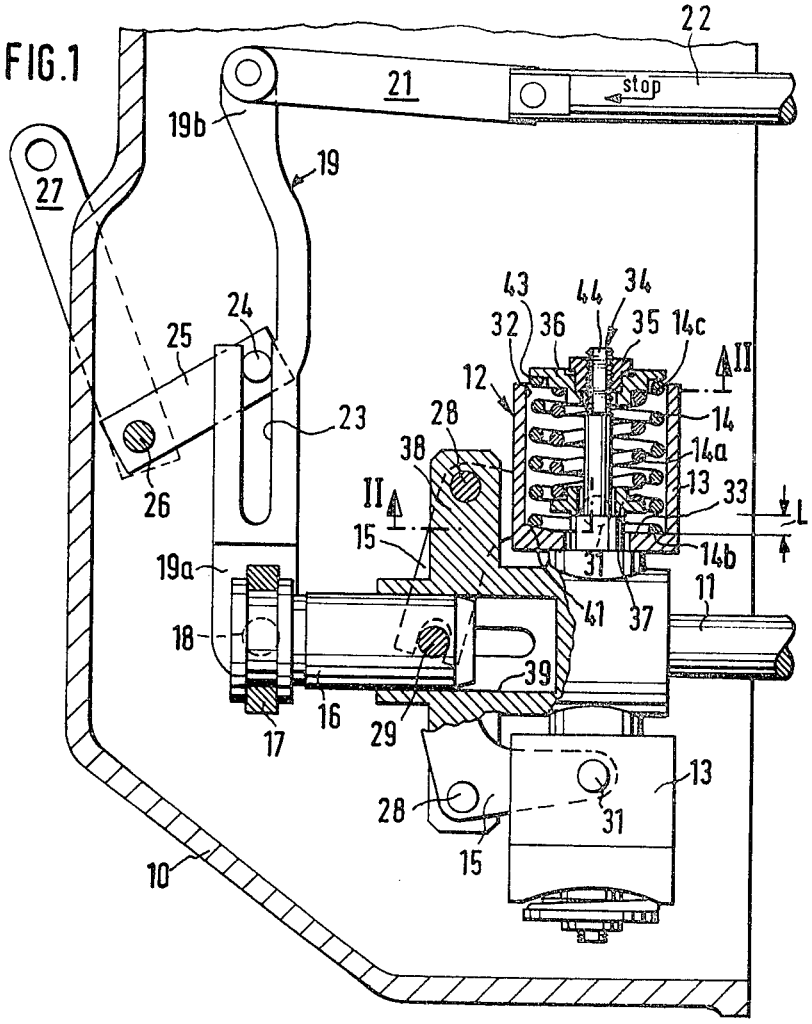
FIG. 1 is a longitudinal sectional view taken through a centrifugal rpm governor constructed in accordance with the invention.

The centrifugal rpm governor of the invention shown in FIG. 1 includes a housing 10, and a known centrifugal governor 12 is fixed on the drive shaft 11 of an injection pump for internal combustion engines which is well known and therefore not described in further detail. The flyweights 13 of the centrifugal governor 12 move outward in a known manner, against the force of regulator springs 14 and **14*a*, from the axis of the drive shaft 11, whereby these regulator movements are transferred through bell cranks 15 onto a regulator sleeve 16**.

Coupled with the regulator sleeve 16, through a slide ring 17 and its bearing tang 18, is an intermediate lever 19. The intermediate lever 19 is formed as a two-armed lever having a first lever arm **19*a* articulately connected with the regulator sleeve 16 and a second lever arm 19*b* articulately connected through a tongue 21 with a regulator rod 22** of the injection pump.

The intermediate lever 19 has a guide slot 23 and a tang 24 as the bearing point, which can slide in this guide slot 23. The tang 24 is part of a steering lever 25, which in turn is rotationally connected through a lever shaft 26 with the adjustment lever 27 acting as the setting member.

The design and mode of operation of this centrifugal rpm governor, which functions as an idling and final rpm governor, are known, and accordingly only the centrifugal governor 21 modified in accordance with the invention will be described in detail. The bell levers 15 functioning as transfer levers are pivotally supported on bearing bolts 28 and articulated by means of a transverse pin 29 onto the regulator sleeve 16. A bolt-shaped transverse shaft 31 connects each of two bell levers 15 with the associated flyweight 13.

The centrifugal governor 12 is equipped with two flyweights 13 disposed symmetrically with respect to each other, the upper one being shown broken away. The upper flyweight 13 has a stepped central bore 32, whose step 33 acts as the spring support for the outer regulator spring 14, which serves as the idling regulator spring and which is in the form of a compression spring. The outward spring end **14*c* is supported on a spring plate 36 which is guided for positive rotation on a stay bolt 34 and fixed by means of an annular nut 35**.

The spring plate 36 acts as a two-part spring support for the idling regulator spring 14 and also for the inner final-rpm-regulating spring 14*a*, which is supported toward the drive shaft 11 on a second spring plate 37. The spring plate 37 in turn rests on a step on the stay bolt 34 and is only rotationally coupled with the regulator movements of the flyweights 13 when the flyweight has completed its idling stroke, marked L in the drawing.

The stay bolt 34 and the bearing bolt 28 are fixed on a flyweight supporter 38 fixed on the drive shaft 11, and the regulator sleeve 16 is guided in the central bore 39 of the flyweight supporter 38.

The flyweight 13, which is actuated by centrifugal force and thus is also the actuation member for the regulator spring 14, can tilt about the transverse shaft 31 and, in order to attain a problem-free regulation, above all in the deregulation point after the idling stroke L has been completed, is intended to stand with its bore bottom, formed by the step 33, at a right angle on the longitudinal axis of the stay bolt 34.

It has been determined that the maximal spring tension in the compression springs with adjoining and sharpened ends which are used here lies in the vicinity of the end of the spring. When this point, designated $P_1$ for the regulator spring 14 and $P_2$ for the regulator spring 14*a*, which transfers the largest spring force component onto the tiltable flyweight or the spring support 37, lies outside a plane which extends parallel to the longitudinal axis of the spring and penetrating the transverse axes A of the flyweights 13, then the deregulation point of the regulator changes accordingly, or the deregulation begins sluggishly; that is, the deregulation curve at first takes an arcuate course. This fault is still further magnified when during operation the particular point, $P_1$ or $P_2$, moves farther outward from the transverse shaft 31.

Figure 2:
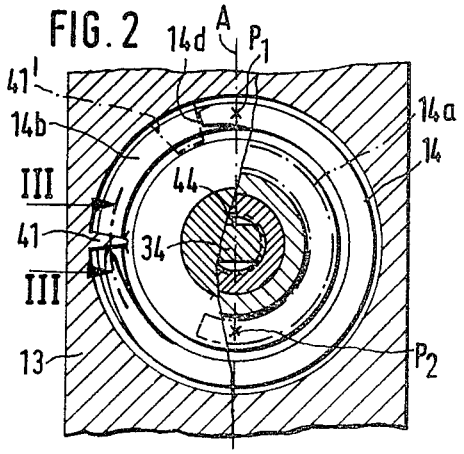
FIG. 2 is a sectional view taken along line II—II of FIG. 1 in the direction of the arrows.

In order to eliminate such faults, the regulator springs 14 and 14*a* are built in in such a way that, as may be seen in FIG. 2, the points $P_1$ and $P_2$ lie exactly on the transverse axis A of the flyweights 13, or stated precisely, in a plane which penetrates these transverse axes A and extends parallel to the longitudinal axis of the springs. When the springs are very greatly stressed initially, they maintain this predetermined installation position, even while the governor is operating. If the initial stressing is small, or if the springs 14 and 14*a* are installed without prestressing, which can be the case, for example, with adjustment rpm governors, then the springs 14 and 14*a* must be locked in their previously described installation position by fastening means. In the centrifugal rpm governor shown in the drawing, it is sufficient to have at least one spring end of both regulator springs 14 and 14*a* fixed on the spring plate 36, which is secured against rotation, by a metallic bonding agent 43 (FIG. 1) which acts as the fastening means.

However, mechanical detent or holding means can also be inserted as fastening means; such as, for example, a bent-back spring end (not shown) inserted into a corresponding bore.

Figure 3:
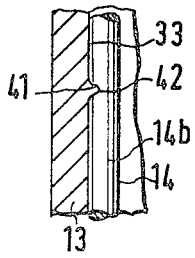
FIG. 3 is a sectional view taken along line III—III of FIG. 2 in the direction of the arrows.

FIGS. 1–3 show a mechanical detent means for the outer idling regulator spring 14 which is formed by a pointed projection 41 on the step 33 in the flyweight 13. This pointed projection 41 engages a corresponding notch 42, which is machined into the end 14*b* of the regulator spring 14 as shown in FIG. 3. The pointed projection may, as is indicated with dot-dash lines in FIG. 2 and identified by reference numeral 41', also form a lateral stop for the outermost spring end 14*d* of the regulator spring 14 and thus serves to prevent the rotation of the spring 14.

In order that the regulator springs 14, 14*a* maintain their installation positions shown in FIG. 2, at least one spring end or one spring support can be provided with an upper surface (not shown) which increases the friction, for the purpose of maintaining the springs in position. If a metallic bonding agent serves as the fastening means for both regulator springs 14 and 14*a*, then the bonding agent, as indicated by reference numeral 43, is inserted between the spring plate 36 and the associated spring end, 14*c*, for example. The spring plate 36 is secured against rotation by means of surfaces 44 located on the stay bolt 34, so that the installation position of the regulator springs 14 and 14*a* is fixed. In this arrangement, the pointed projection 41 and the associated notch 42 can be eliminated, which is particularly advantageous in highly stressed and thin springs, since notch stresses caused by the notch 42 are avoided.

Still other possible connector, holder, and detent means are conceivable as the fastening means; however, it is the intended installation position of the regulator springs for the purpose of avoiding tilting moment which is the essence of the invention. The invention can also be used in any other regulator or control apparatus where regulator springs cooperate with a tiltable actuation member.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A spring controlled regulator having two spring supports, at least one compression spring interposed between two of said spring supports forming a regulator spring, an actuating member which transfers regulator motions onto one end of at least one spring which tends to cause a change in the length of said spring, said actuating member being tiltable about a transverse axis disposed perpendicularly to the longitudinal axis of said at least one spring, said at least one compression spring being inserted in an installed position between at least two spring supports such that a point on the front face of the end of said spring end, which point transfers the largest spring force component onto the spring support associated with said tiltable actuating member, lies in a plane extending parallel to the longitudinal axis of the spring and penetrates the transverse axis of said actuating member for the purpose of eliminating an undesired tilting movement of said actuating member caused by at least one spring force exerted eccentrically on the spring supports.

2. An apparatus in accordance with claim 1, which includes fastening means for fixing the installation position of at least one of said regulator springs between at least one spring end and the associated spring support and means for receiving said spring support in such a manner that it is secured positively against rotation.

3. A regulator apparatus in accordance with claim 2 wherein said fastening means comprises a metallic bonding agent.

4. A regulator apparatus in accordance with claim 2 characterized in that at least one of said spring end and spring support is provided with an upper surface for increasing the friction, for the purpose of maintaining said regulation spring in the installed position.

5. A regulator apparatus in accordance with claim 2 wherein said fastening means comprises mechanical detent means.

6. A regulator apparatus in accordance with claim 5, wherein said mechanical detent means comprises a pointed projection on said step of the central bore of the flyweight.

7. A regulator apparatus in accordance with claim 6 including a corresponding notch on the spring end of said regulator spring arranged for engagement by said pointed projection.

8. A regulator apparatus in accordance with claim 6 wherein said pointed projection is arranged to retain the outermost spring end of said regulator spring against rotation, said outermost spring end being arranged to contact said pointed projection laterally.

9. A regulator apparatus arranged as a centrifugal governor, said regulator apparatus comprising a flyweight support means, two symmetrically disposed flyweights which act as actuating members, a transverse shaft secured to each of said flyweights, said transverse shafts articulately connecting each of said flyweights to a transfer lever, said flyweights including a stepped central bore, an axially disposed aperture in said flyweights, a stay bolt extending from said flyweight support coaxially through said aperture and said flyweights, said stay bolt including a shoulder on its end near said flyweight support, a first regulator spring support formed by said stepped central bore in each of said flyweights, a second regulator spring support fixed on said shoulder of said stay bolt, a first regulator spring in each of said flyweights, a second regulator spring in each of said flyweights, an outer spring support means for supporting each of said first and second springs supported in each of said flyweights, means for fixing each of said regulator springs relative to said spring supports and means for fixing said spring support against rotation relative to said flyweights.

* * * * *